US006444932B1

(12) United States Patent
Resmalm

(10) Patent No.: US 6,444,932 B1
(45) Date of Patent: Sep. 3, 2002

(54) SAFETY SWITCH

(75) Inventor: Monia Resmalm, Vasteras (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/937,405

(22) PCT Filed: Mar. 30, 2000

(86) PCT No.: PCT/SE00/00616

§ 371 (c)(1),
(2), (4) Date: Sep. 26, 2001

(87) PCT Pub. No.: WO00/60621

PCT Pub. Date: Oct. 12, 2000

(30) Foreign Application Priority Data

Apr. 1, 1999 (SE) ..... 9901201

(51) Int. Cl.[7] ..... H01H 13/00; H01H 9/20

(52) U.S. Cl. ..... 200/334; 200/520; 200/538; 200/296; 200/318.2; 200/341

(58) Field of Search ..... 200/16 R, 16 B, 200/16 C, 17 R, 43.01, 43.11, 43.13, 43.16, 43.18, 520, 537, 538, 293, 296, 318, 318.1, 318.2, 323–325, 329, 334, 341

(56) References Cited

U.S. PATENT DOCUMENTS 3,472,986 A * 10/1969 Stallman ..... 200/313
4,451,720 A * 5/1984 Ludwig ..... 200/295
5,055,643 A 10/1991 Pardini et al. ..... 200/318.2
5,178,504 A * 1/1993 Falchi ..... 200/296
5,180,050 A 1/1993 Rada et al. ..... 200/329
5,593,022 A * 1/1997 Schaeffer et al. ..... 200/308
5,679,936 A * 10/1997 Schaeffer et al. ..... 200/17 R
5,684,670 A * 11/1997 Zimmermann et al. ..... 200/296
6,198,058 B1 * 3/2001 Graninger et al. ..... 200/16 R

* cited by examiner

*Primary Examiner*—Michael Friedhofer
(74) *Attorney, Agent, or Firm*—Dykema Gossett PLLC

(57) ABSTRACT

Operating means for the operating of a switch (2) in an electric current circuit, comprising an inner cylinder (6) connected to the switch, with a push rod (7) axially displaceable in the inner cylinder between an outer resting position and an inner operative position wherein the push rod acts on the switch to break the current circuit, and wherein a the push rod during displacement to the active position passes and is releasably locked in the active position by being arrested behind a spring member supported on the inner cylinder. The movement of the push rod in a direction towards the resting position is axially limited by an outer cylinder which is journalled about the inner cylinder and the cylinders are inter-locked in the coupled position through the aid of snap-lock means acting between and being encased between the cylinders in their interconnected position.

10 Claims, 2 Drawing Sheets

SAFETY SWITCH

TECHNICAL FIELD OF INVENTION

Figure 1:
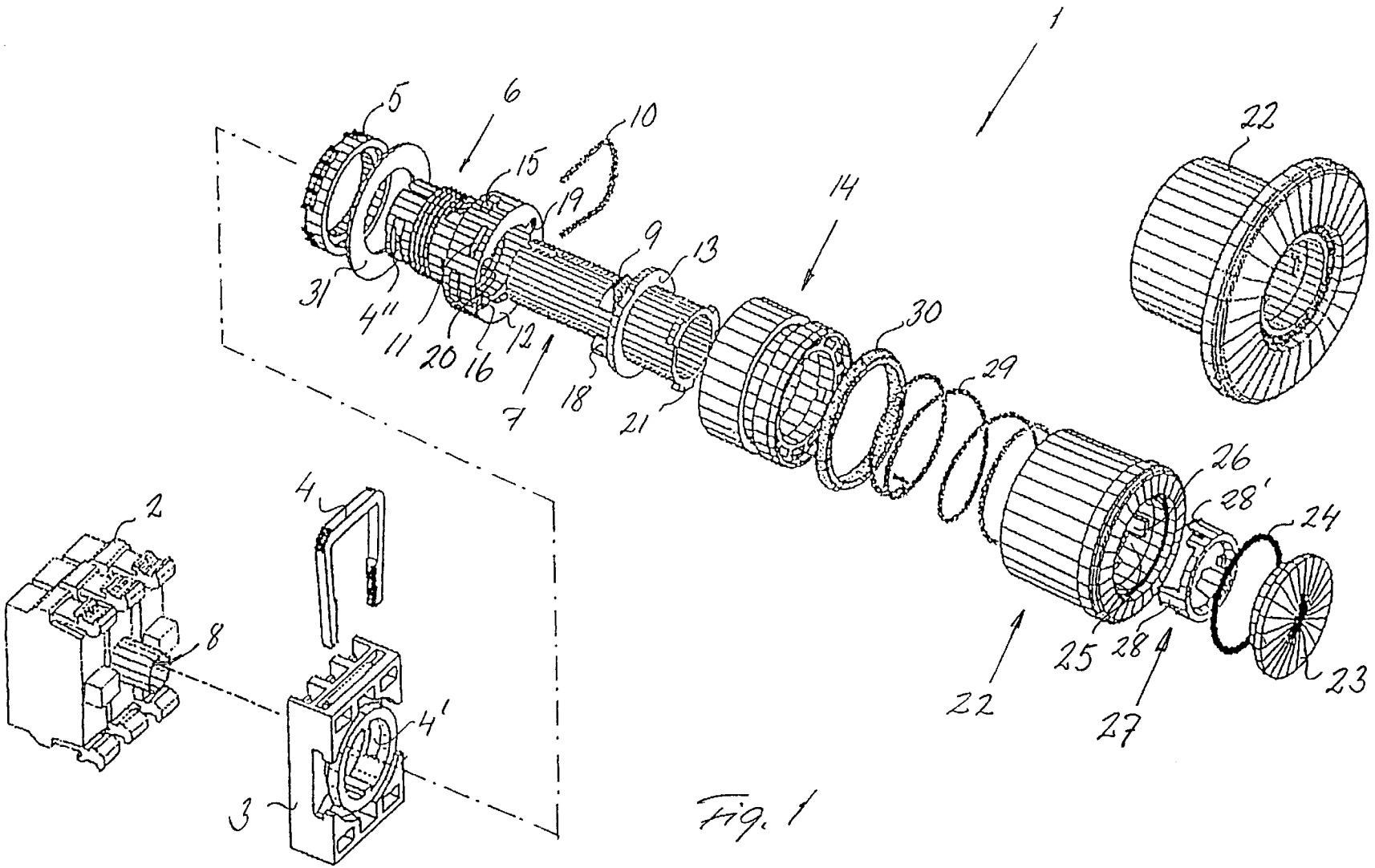

The present invention relates to the operating of a switch for manual switching off of an electric current circuit, and more particularly pertains to an operating means with which, in a case of emergency, the current circuit may be switched off and closed again only through a manual activation of the operating means when the emergency situation has been remedied. More specifically, the invention provides improvements on such safety switches in respect of the ability to withstand outer manipulation, and in particular unauthorised dismounting of the installed safety switch.

Herein, the expression "safety switch" refers to a separate operating means by which a switch is operated for switching off an electric power circuit.

TECHNICAL BACKGROUND

Safety switches of various types are previously known, by which a restorable switch is operated in emergency situations for disconnecting an electric circuit by hitting or pressing a press button of the safety switch. Connection may be restored through a pulling or turning motion of the button to overcome or avoid the effect of a spring or other locking element that engages a movable portion of the safety switch, arranged for securing the disconnected condition.

A frequent problem in connection with safety switches that are installed in environments that are non-restricted and thus available for the public is damages caused on the safety switch. Such damages may involve unauthorised dismounting of the push button or of the entire safety switch, or manipulation of its function. In all cases the safety switch loses its ability to prevent a dangerous outcome in case of a malfunction of an electrical apparatus. A manipulation of the function of the safety switch may not necessary be detected before the emergency situation arises, thus adding to the risk of a hazardous outcome.

A technical problem in respect of the above said is to design the safety switch in such way, that after installing,. it will be impossible to dismount or manipulate the safety switch without leaving visible damages on the exterior of the safety switch.

OBJECT OF INVENTION

It is thus a primary object of the invention to provide a safety switch having mounting means that are inaccessible from the outside when the safety switch is assembled.

SUMMARY OF THE INVENTION

According to the invention there is provided an operating means for operating a switch in an electric current circuit, comprising an inner cylinder connected to the switch, a push rod being axially displaceable relative to the inner cylinder between an outer rest position and an inner active position wherein the push rod effects the switch to break the current circuit, and under displacement to the active position the push rod passes and releasably locks into the active position by engagement with a spring member supported by the inner cylinder, and a push button is connected to the push rod for moving the push rod between said positions. An outer cylinder limits the axial travel of the push rod towards the rest position. Upon assembly, the outer cylinder is journalled about the inner cylinder and the cylinders are then mutually rotated to a coupled position in which the cylinders are inter-locked by a snap-lock means that is encased by the superimposed outer cylinder in the assembled position and operative for preventing a relative rotation of the cylinders in the locked position.

Other objects and advantageous embodiments of the invention are further defined in the subclaims and the following description of exemplifying embodiments, respectively.

DRAWINGS

Figure 2:
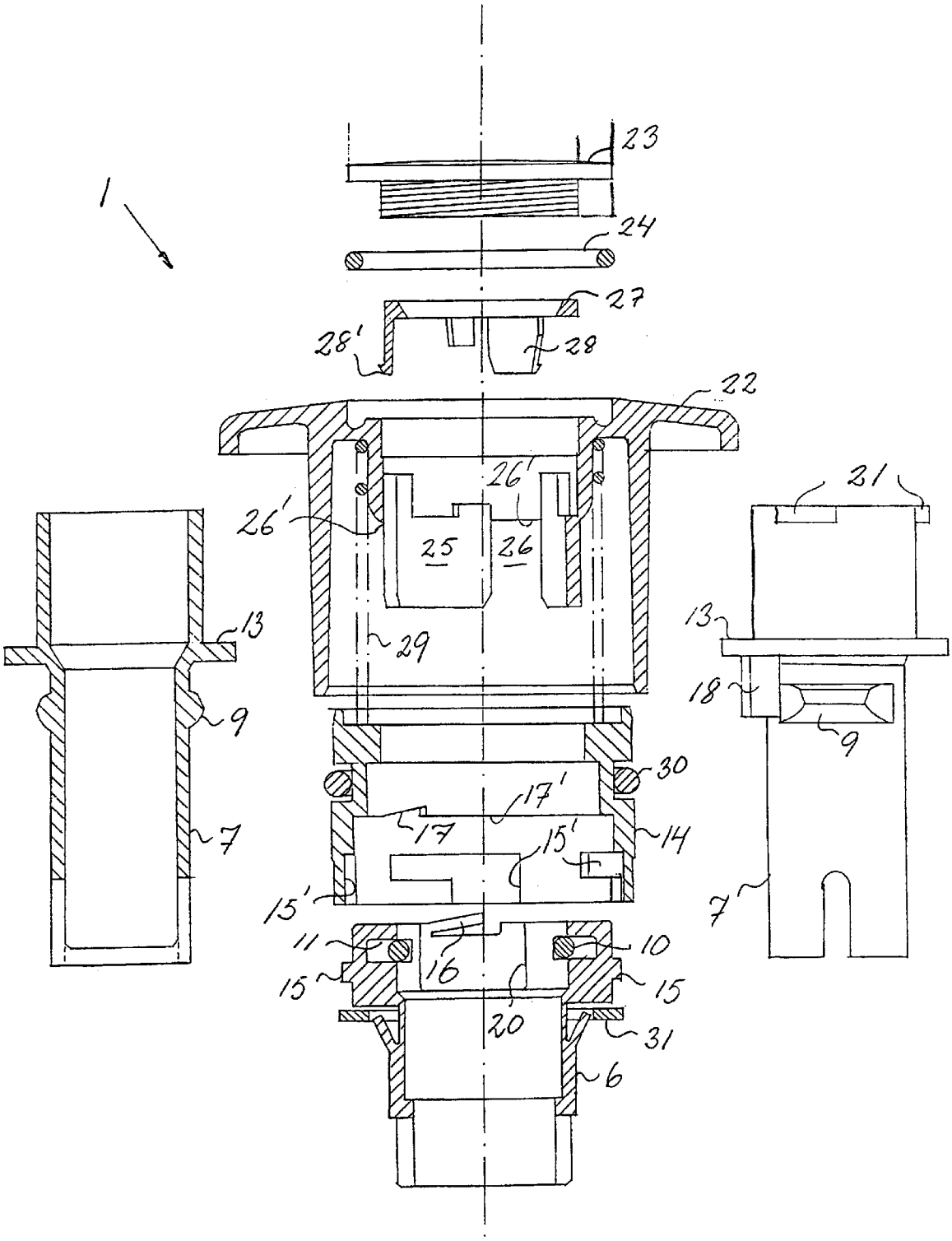

Below, the invention will be more closely described with reference made to the accompanying drawings, wherein FIG. 1 is an exploded view showing the separate elements of the safety switch in a non-assembled position, and FIG. 2 is an axial cross sectional view through the separate elements of the safety switch, also shown in the non-assembled position and with a push rod incorporated in the safety switch shown also in a transverse side view.

DETAILED DESCRIPTION

Referring to FIGS. 1 and 2 there will be described a safety switch 1 according to the invention in a currently preferred embodiment.

In this embodiment, the safety switch 1 is designed to operate a contact block 2, which is controlled by the safety switch to break, in case of an emergency, an electric power circuit to which the contact block is connected. A carrier 3 that is formed to receive and hold the safety switch, e.g. by way of a spring 4 supports the contact block. The spring 4 is inserted into slots 4' and 4" arranged on the contact block carrier 3 and the safety switch 1, respectively, and acting to hold these axially and against relative rotation. The carrier 3 and the contact block 2 are preferably arranged within a panel or front plate (not shown) of an apparatus box or the like, whereby the safety switch 1 is mounted through a hole in the panel and fixed by a nut 5. In the assembled position the nut is screwed onto an inner cylinder 6 which extends through the panel and into the contact block carrier 3.

A push rod 7 is arranged so as to be axially displaceable in the inner cylinder 6. In a case of emergency the push rod is operated via a push button, further described below, to press a switch 8 on the contact block in order to break the power circuit. This position refers to the operative or activated position of the push rod or the safety switch, respectively, in this disclosure.

On its outside, the push rod 7 is formed with two diametrically opposing shoulders, of which only one shoulder 9 is shown in FIG. 1. When the push rod is moved to the active position, said shoulders pass through a U-shaped spring member 10 to be releasably arrested behind the legs of the spring member 10. The spring member 10 is supported by the inner cylinder 6 to extend transversely relative to, and on opposing sides of the push rod 7, and is pushed tangentially into the cylinder 6 to be rested in grooves 11 arranged in a collar section 12 of the cylinder 6. In the shown embodiment the spring member 10 is shown to be extended tangentially in relation to the push rod 7, having a circular cross section, and being fixed in the rested position by an outer cylinder which is described below.

The push rod 7 has a collar 13 extending radially outside the shoulders 9. In the non-operative position (rest position), the collar 13 abuts a flange arranged on the inside of an outer cylinder 14.

When assembled, the outer cylinder 14 is shaped to be superimposed or journalled about the inner cylinder 6 so as to extend concentrically about the outside of this, preferably for the whole axial length of the collar section 12 of the inner cylinder 6. The cylinders are mutually connected through a bayonet mount, for which purpose shoulders 15 are arranged outwardly on the collar section 12 of the inner cylinder 6. The shoulders 15 are inserted into sockets 15' arranged on the inside of the outer cylinder 14, and are brought to an end position in the sockets 15' upon relative rotation of the cylinders whereby the cylinders are axially connected. A snap lock means is arranged to act between the inner surface of the outer cylinder 14 and the outer surface of the inner cylinder 6. The snap lock means comprises a flexible tongue 16 formed on the outside of the inner cylinder. When the shoulders 15 are rotated to the end position of the bayonet mount, the tongue 16 snaps into a groove 17, see FIG. 2, formed on the inside of the outer cylinder 14. Thus, when the cylinders are mutually connected the snap lock means is encased between the cylinders and may only be accessible by tearing apart the outer cylinder 14. The tongue 16 prevents relative rotation of the cylinders 6 and 14 in the position where the tongue has snapped into the groove 17, so that the cylinders also are rotationally fixed.

The shoulders 15 of the inner cylinder 6 and the sockets 15' of the outer cylinder 14, respectively, are preferably designed to allow, only in a certain rotational position, the outer cylinder to be pushed onto the inner cylinder. Such restriction may be applied e.g. by a non-symmetrical positioning of shoulders and sockets in the peripheries of the two cylinders, or by arranging one or more of the shoulders and sockets with a different length than the other shoulders/sockets. Furthermore, the tongue 16 may as in the shown embodiment be circumferentially oriented on an inner end surface of the inner cylinder 6, and the groove 17 may be realized as a recess in the front face of a shoulder 17', against which said end of the inner cylinder is in abutting contact in the coupled mode of the cylinders. Alternatively, the snap lock means may also comprise several flexible tongues or grooves 16 and 17, respectively.

The safety switch 1 according to the shown embodiment is configured in the way described below to be freely adapted for a pulling operation or a turning operation when the push rod 7 is to be reset to its rest position.

Before connecting the inner and outer cylinders 6 and 14, respectively, the push rod 7 is fitted into the inner cylinder. To this end the push rod is provided with a guide in the form of an axially running projection 18 formed on its outside. During assembly the projection 18 is fitted into one of two alternative grooves 19 or 20 running axially on the inside of the inner cylinder 6. The groove 19 is dimensioned to receive the projection 18 substantially rotationally fixed therein, while the groove 20 is configured to receive the projection for a limited rotation therein.

It will be appreciated that when the push rod is mounted for guidance in the groove 19 resetting of the push rod 7 occurs in an axial pulling motion against the action of the spring member 10. When the push rod is mounted for guidance in the groove 20 resetting of the push rod 7 occurs in a rotational movement in which the shoulders 9 pass freely of the respective legs of the spring member 10.

In an outer end, the push rod 7 is provided with a number of heels 21. When assembled, the heels 21 engage shoulders that are arranged on a push button 22 further described below.

The push button 22 is shaped as a cup, formed internally with coupling means by which the push button is connected to the push rod 7. Alternatively, the push button may be formed with a large end plane having a lower side from which a sleeve is depending and arranged internally with coupling means for connection to the push rod 7. In both cases, the end plane of the push button is formed with a seat for receiving a cover plate 23, screwed or snapped into the seat so as to be levelled with or positioned below the end plane. A sealing ring 24 may, if necessary, be fitted to rest in a groove inwardly of the cover plate to prevent dampness from getting into the push button.

The connection between the push rod 7 and the push button 22 is realized through the angularly spaced heels 21 of the push rod, in the connected position resting against the top of correspondingly formed shoulders 25 extending radially inwardly from the inner periphery of the sleeve or cup-shaped wall of the push button. Upon assembly, the push button is pushed over the end of the push rod by turning these mutually so that the shoulders 21 may pass in recesses 26 formed between the shoulders 25, whereupon the push button is rotated in order to bring the shoulders 21 and 25 into engagement.

A washer 27 secures the connection between the push rod 7 and the push button 21. The washer 27 comprises a ring, from which flexible legs 28, depending in axial direction, are formed in the tips thereof with hook-shaped gripping means 28' protruding radially outwards from the tips. In the secured position, the gripping means are arrested behind shoulders 26' formed in the recesses 26. Thus, in the snapped-in position of the washer, the legs 28 extend axially in the recesses 26, and prevent a rotation of the push button relative to the push rod. At the same time, the washer 27 is axially fixed in the push button by the engagement of the gripping means 28' behind the shoulders 26' of the recesses 26, so that the ring-shaped section of the washer axially secures the connection between the push button 22 and the push rod 7.

A coil spring 29 is provided to act between the outer cylinder 14 and the push button 22, so that the push rod 7 is biased in the direction of the resting position. For this purpose, the sleeve or cup-shaped portion of the push button 22 is formed with an annular and concentric groove for receiving the coil spring 29. In its ends, the coil spring 29 is formed with means, not showed in detail, e.g. bent or angular sections for non-rotational engagement with the cylinder 14 and the push button 22, whereby the spring also acts to rotate the push rod back to an initial position after resetting through a turning operation. The groove is dimensioned to allow journalling of the push button on the outer cylinder 14 in the assembled position, whereby a ring-shaped seal 30 may be applied for sealing between the outer cylinder and a peripherally outer wall of the groove. Hereby it may be secured that dampness is prevented from getting in between the push button and the outer cylinder.

In the assembled position, the outer cylinder 14 extends with the inner end thereof in a plane coincident with the lower edge of the collar section 12 of the inner cylinder 6. In this position, a sealing ring 31 may be fitted between the panel, cover plate or similar facing of the contact block, and the inner end of the outer cylinder, to make sure that dampness is prevented from getting in between the inner and outer cylinders 6 and 14, respectively.

In a preferred embodiment the push rod 7 is a hollow member, and the cover plate 23 translucent, so that a light source arranged in the contact block or the switch may be visible through the safety switch 1. For this purpose, the push rod is advantageously formed in its inner end with one or more transverse beams, e.g., not shown in detail, for engagement with the switch of the contact block.

In the above description of an embodiment there has been suggested an operating means for operating a switch in an electric current circuit, or a safety switch, wherein elements are designed to co-operate for enclosing and preventing unauthorised access to the interlocking means arranged for connecting the elements in the assembled position of the safety switch. A central feature of the invention is the encased snap-lock connection between the inner and outer cylinders, respectively. Upon assembly, the snap-lock means allow the relative rotation of the cylinders into an interlocking position, wherein the cylinders are non-rotationally interconnected so that access to the connection is possible only by tearing apart the outer cylinder. Another central feature of the invention is the encased snap-lock connection between push button and push rod, and a further advantageous feature is the optional assembly of the push rod for a pulling or a turning operation, when the safety switch is to be reset.

In this embodiment, the snap-lock means 16, 17 are designed to be effective in a peripheral area between the inner cylinder 6 and the outer cylinder 14, and arranged to operate in axial planes of the cylinders.

Without specifically being shown herein, it is appreciated that a snap-lock means may alternatively be realized as a tongue formed on the inside of the inner cylinder, adapted to lock by snapping into a groove formed on the inner periphery of the outer cylinder upon relative rotation of the cylinders to an end position. In both cases, the snap-lock means operate with a tangentially directed component force, in the first case between axially directed surfaces and in the second case between radially directed surfaces, to prevent a relative and disconnecting rotation between the outer and inner cylinders after assembly.

The object of the invention is achieved by the unreleasably interconnected cylinders 6 and 14, the locking connection of which is inaccessibly enclosed between the cylinders in the locking position. Any manipulation that would result in affecting the current breaking function of the safety switch requires an irreparable damage to be caused on the outer cylinder 14.

The effect of the invention is furthermore improved by the likewise inaccessibly enclosed connection between the push button 22 and the push rod 7, the separation of which may only be effected through an irreparable damage caused to the cover plate 23 and the locking washer 27.

An advantageous feature of the invention is the freedom of choice between a pulling or turning operation in order to reset the push rod, made possible by the alternative reception and guide positions 19 and 20, respectively, of the inner cylinder.

Furthermore, the safety switch according to the invention is, in its entirety, sealed against intruding dampness or dirt when mounted out of doors or in aggressive environments, and it is designed for passage of the light from a light bulb or light diode, arranged in the switch.

The elements and details incorporated in the safety switch are preferably formed of synthetic materials with high resistance against extreme temperatures and chemically aggressive substances.

What is claimed is:

1. Operating means for operating a switch in an electric current circuit, comprising an inner cylinder connected to the switch, a push rod axially movable relative to the inner cylinder between an outer resting position and an inner active position wherein the push rod acts on the switch to break the current circuit, and wherein the push rod during movement to the active position passes and is releasably locked in the active position through the engagement with a spring member supported on the inner cylinder, said operating means further being provided with a push button connected to the push rod for operation of the push rod between said resting and active positions, wherein the movement of the push rod in a direction toward the resting position is axially limited by an outer cylinder, which upon assembly is journalled concentric about the inner cylinder whereafter the cylinders are mutually rotated to a locking position, and wherein the cylinders are unreleasably interlocked through a snap-lock means encased by the superimposed cylinders and effective for preventing the relative rotation of the two cylinders in the inter-locked position.

2. Operating means according to claim 1, wherein the snap-lock means is operable with a tangentially directed component force between axially directed surfaces of the inner and the outer cylinders, respectively.

3. Operating means according to claim 2, wherein the snap-lock means comprises a tongue forming part of a bayonet mount, said tongue snapping into a groove when the bayonet mount is rotated to an end position wherein the cylinders are interconnected, wherein the tongue and the groove are circumferentially oriented and the tongue is formed on an inner end surface of the inner cylinder and the groove is formed on a front face of an inner shoulder of the outer cylinder, so that the snap-lock means is encased between the cylinders in their interconnected position.

4. Operating means according to claim 1, wherein the snap-lock means is operable with a tangentially directed component force between radially directed surfaces of the inner and outer cylinders, respectively.

5. Operating means according to claim 4, wherein the push button comprises a cylinder sleeve concentrically surrounding the outer cylinder in the assembled position, a first sealing ring being fitted between the sleeve and the cylinder, a second sealing ring being arranged inwardly of a cover plate attached in the end plane of the push button, and a third sealing ring being arranged between the outer cylinder and the switch, or a panel arranged outwardly of the switch, so that the operating means is completely sealed from intruding the dampness or dirt.

6. Operating means according to claim 4, wherein the push rod is a hollow member, and the cover plate is translucent.

7. Operating means according to claim 1, wherein the push rod on its outside is formed with two projecting, diametrically opposed shoulders which upon operation of the push rod to its active position are releasably arrested behind legs of the spring member, the spring member being supported on the inner cylinder to extend transversely to the push rod and on each side thereof, whereby the push rod is released from the active position by a pulling operation of push button toward the resting position of the push rod and against the force of said spring member.

8. Operating means according to claim 7, wherein the push rod in its periphery is provided with an axially extending projection and which upon assembly of the operating means alternatively is inserted into one of two grooves formed on the inside of the inner cylinder and extending axially therein, the peripheral length of one of said grooves being adapted for non-rotationally receiving and guiding of the push rod, and the peripheral length of the other groove being adapted to receive and guide the push rod for limited rotation therein.

9. Operating means according to claim 1, wherein the push rod on its outside is formed with two projecting, diametrically opposed shoulders which upon operation of the push rod to its active position are releasably arrested behind legs the spring member, the spring member being supported on the inner cylinder to extend transversely to the push rod and on each side thereof, whereby the push rod is released from the active position by a turning operation of the push button for releasing the shoulders from being arrested behind the legs of said spring member.

10. Operating, means according to claim 1, wherein the connection between the push rod and the push button comprises a bayonet mount, which is locked in the interconnected position by a washer formed to be inserted below the cover plate, the washer having snap-lock means that snap onto shoulders formed internally in the sleeve of the push button, whereby the snap lock means of the inserted washer prevents relative rotation between the push button and the push rod.

* * * * *